United States Patent [19]

Anderson et al.

[11] 4,279,707

[45] Jul. 21, 1981

[54] ELECTROPLATING OF NICKEL-IRON ALLOYS FOR UNIFORMITY OF NICKEL/IRON RATIO USING A LOW DENSITY PLATING CURRENT

[75] Inventors: Nathaniel C. Anderson, Pine Island, Minn.; Charles R. Grover, Jr., San Jose, Calif.

[73] Assignee: International Business Machines Corporation, Armonk, N.Y.

[21] Appl. No.: 122,628

[22] Filed: Feb. 19, 1980

Related U.S. Application Data

[63] Continuation of Ser. No. 970,709, Dec. 18, 1978, abandoned.

[51] Int. Cl.[3] ..... C25D 3/56

[52] U.S. Cl. ..... 204/43 T

[58] Field of Search ..... 204/43 T, 123

[56] References Cited

U.S. PATENT DOCUMENTS

| | | | |
|---|---|---|---|
| 3,031,386 | 4/1962 | Tsu et al. | 204/43 |
| 3,622,469 | 11/1971 | Alberts et al. | 204/43 T X |
| 4,053,373 | 10/1977 | McMullen et al. | 204/43 T |
| 4,102,756 | 7/1978 | Castellani et al. | 204/43 T |

FOREIGN PATENT DOCUMENTS

| | | | |
|---|---|---|---|
| 762435 | 7/1967 | Canada | 204/26 |
| 1259666 | 1/1968 | Fed. Rep. of Germany . | |
| 2105529 | 9/1971 | Fed. Rep. of Germany . | |
| 2202953 | 10/1974 | France . | |
| 2245784 | 4/1975 | France . | |
| 1323826 | 7/1973 | United Kingdom . | |
| 1414353 | 11/1975 | United Kingdom . | |

*Primary Examiner*—G. L. Kaplan

*Attorney, Agent, or Firm*—Graham S. Jones, II

[57] ABSTRACT

Electroplating nickel-iron alloys onto objects having complex topographical shapes with projections and hollows such as upper pole pieces of thin film magnetic recording heads has been found to yield a substantial variation in nickel-iron alloy composition from point to point within a single pattern. Providing a low total dischargeable ion concentration in the bath is helpful to reduce such variations when plating in the 80:20 Ni:Fe alloy range. That is, it is desirable to use a low value of $Fe^{++}$ and $Ni^{++}$ ion concentrations and a relatively low current density to operate at the relatively flat peak of the curve of the iron percentage in the plated alloy vs. current density curve. The curve can be raised or lowered by increasing or decreasing the total dischargeable ion concentration respectively for a given $Ni^{++}/Fe^{++}$ ion ratio. The preferred $Fe^{++}$ ion concentration range for Ni:Fe alloy ratio near 80:20 is about 0.15–0.3 g/l for a range of 10–14 g/l of $Ni^{++}$ ion in a solution with a pH of about 3, a temperature of about 20°–35° C. where the $Ni^{++}/Fe^{++}$ ratio in the solution ranges from about 45 to 1 to about 70 to 1. Preferably, an electrolyte for reducing pitting such as 0–100 g/l of NaCl is employed. The cation ($Na^{+}$) of the latter electrolyte should not be a dischargeable ion. Plating current density is preferably between about 2 ma/cm$^2$ and 12 ma/cm$^2$, and optimum results are achieved for values from about 4 to 8 ma/cm$^2$.

9 Claims, 17 Drawing Figures

ELECTROPLATING OF NICKEL-IRON ALLOYS FOR UNIFORMITY OF NICKEL/IRON RATIO USING A LOW DENSITY PLATING CURRENT

This is a continuation of application Ser. No. 970,709 filed Dec. 18, 1978, and now abandoned.

DESCRIPTION

1. Technical Field

This invention relates generally to electroplating of nickel-iron alloys and more specifically to providing alloy films with a uniform nickel-iron composition ratio across the surface of objects having complex shapes such as thin film 80:20 Ni-Fe magnetic pole pieces for magnetic recording heads.

2. Background Art

Thin film of approximately 80:20 Ni:Fe alloy composition commonly known as Permalloy alloy have low coercivity and high permeability. Those qualities make such films highly suitable for use in magnetic switching, recording heads and memory devices. We have discovered that devices with complex topographical shapes made by plating with previously known baths exhibit a substantial gradient in the nickel/iron composition ratio from point to point within a device. We have also discovered that the gradients result from the variations in current densities from point to point across the topography of an object being plated which has such a complex shape. For objects such as magnetic pole pieces for magnetic recording heads employed in high density, high speed magnetic recording for data processing systems and the like, uniformity of quality is critical. Substantial variation from uniformity of composition of Ni:Fe 80:20 alloys is undesirable. For example it can produce magnetostrictive alloys with high coercivity which can be unsatisfactory for use in products which require low coercivity. A substantial gradient of the Ni:Fe composition ratio along the surface of a magnetic recording head element significantly affects magnetic recording performance of the head adversely. A variation in current density from point to point along the surface of a head during an electroplating operation has been found to be very significant in its effect of varying uniformity of the composition ratio of plated films. It is, therefore, a primary object of the present invention to provide a nickel-iron electrodeposition process operable with a plating current of a low current density for plating a flim which provides a minimal gradient of the composition ratio of nickel to iron along a complex surface.

Electrodeposition of nickel-iron thin films has long been known using an aqueous solution of nickel and ferrous sulfamates, sulfates and chlorides. In a plating bath the ratio of the nickel ion concentration to the ferrous ion concentration has generally been above 30 to 1, the pH has been within the range between 2 and 3.5, and the solution temperature has been maintained below 30° C. The current density has been maintained generally above 10 milliamps per square centimeter of cathode area.

For instance, U.S. Pat. No. 3,027,309 of Stephen et al discloses the deposition of a nickel iron composition using a solution of nickel and ferrous sulfamates with a ratio of nickel to iron concentration to ferrous iron concentration of between 35 to 1 and 40 to 1 with a pH of between 2 and 3.5. The extremely high nickel ion concentration is stated as 113 g/l, and the ferrous ion concentration is 2.82 g/l. The solution temperature is maintained below 30° C. and, after a striking current, a deposition current density is maintained at approximately 10 milliamps per square centimeter of cathode area.

Another U.S. Pat. No. 3,317,410 of Croll et al assigned to the assignee of the present invention, discloses an electrodeposition system for nickel-iron alloys using a chloride metal salt solution containing boric acid, sodium lauryl sulfate, and sodium saccharin. The operating conditions are a pH of 3.0 and a current density of 25 milliamps per centimeter squared. Nickel concentration in one example is about 49 g/l and $Fe^{++}$ ion concentration is about 0.12 g/l or in a separate example, it is about 0.98 g/l in Tables I and II thereof respectively. No range of values is suggested. The nickel to iron ion concentration ratio is about 500 to 4 or about 50 to 1. Values in between Tables I and II are not discussed or suggested. The current density is relatively high.

U.S. Pat. No. 4,102,756 filed on Dec. 30, 1976 to E. E. Castellani et al and assigned to the assignee of the present invention discloses a nickel-iron alloy electroplating system comprising a high plating current density process of 10–200 milliamps per centimeter squared. In Table VII for plating 80:20 NiFe alloy onto a flat sheet it uses 1.1–1.7 g/l of $Fe^{++}$ ions and 7–37 g/l of $Ni^{++}$ ions or a nickel ion to ferrous ion concentration ratio from about 6.4 to 1 to 22 to 1. When plating into openings in a mask (Table VIII) preferably at a plating current density from 2 to 60 ma/cm$^2$, it uses 0.3–0.7 g/l of $Fe^{++}$ ions and 17–44 g/l of $Ni^{++}$ ions. The Ni/Fe ion ratio is about 60 to 1. The current densities used and the ion concentrations used are too high to produce uniformity of plating onto an object with a high degree of variation in the topography of the object.

It is therefore an object of the present invention to provide an electrodeposition process for a nickel-iron alloy of approximately 80:20 alloy using a critical low current density and critical ranges of low values of nickel and ferrous ion concentrations in the proper ratio with a relatively low concentration of dischargeable ions.

SUMMARY OF THE INVENTION

The present invention comprises a nickel-iron electroplating system for coating a complex substrate having a mask deposited thereon with a layer of a nickel-iron magnetic material having a small compositional change across the topography of a complex shape. Electroplating of a nickel-iron alloy film onto a sheet substrate forms a layer of a magnetic material. Conditions employed include a plating current density of from about 2 milliamps per centimeter squared to 12 milliamps per centimeter squared onto objects in a plating bath having a ferrous ion concentration of about 0.15 grams per liter to about 0.3 grams per liter and a nickel-ion concentration of about 10 g/l to 14 g/l. The pH of the system is maintained at about 3 at a temperature of about 20°–35° C., wherein the ratio of nickel ion to ferrous ion concentration is from about 45 to 1 to about 70 to 1.

In particular, the electrodeposition of approximately 80:20 nickel-iron alloy according to the present invention can include chloride and sulfate metal salts of nickel and iron together with boric acid, sodium saccharin, a wetting agent and sodium chloride. The temperature is maintained at approximately 23° C. at a pH of about 3.0. A current density of about 4–8 milliamps per centimeter squared can be used most advantageously.

The electrodeposition process of the present invention is especially useful to provide thin layers of magnetic material for pole pieces of magnetic heads.

It is therefore an object of the present invention to provide an advanced electrodeposition process for nickel-iron alloys.

Yet another object is to provide a low current density bath with relatively low nickel and relatively low ferrous ion concentrations to provide magnetic film deposition having a minimal gradient of the composition ratio between Ni and Fe in the plated film as a function of current density and as a function of the topography of a complex object being plated.

BRIEF DESCRIPTION OF THE DRAWINGS

FIG. 6 shows five curves for varying quantities of NaCl in the bath.

DISCLOSURE OF INVENTION

Figure 1A:
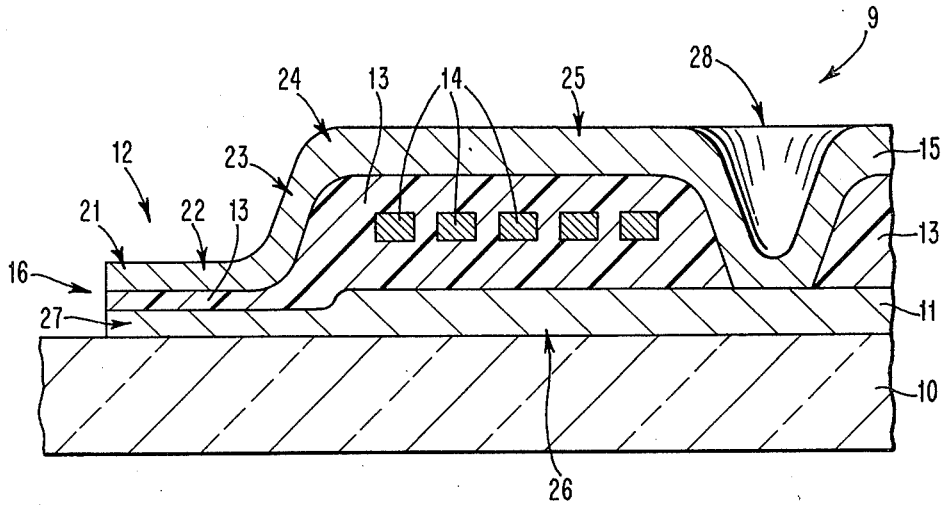
FIG. 1A shows a sectional view of a thin film inductive magnetic recording head with an electroplated upper pole piece having a substantial degree of topographical curvature tending to cause nonuniformity of plating current density.

FIG. 1A shows a sectional view of a thin film magnetic recording head 9 with a substrate 10 of a material such as $SiO_2$ upon which a first thin film magnetic pole piece layer 11 of Permalloy alloy is deposited, with a greater thickness beyond the throat area 12. Above layer 11 is deposited an insulator 13 of a material such as a baked photoresist. Copper coils 14 are deposited upon the insulator 13. Above the coils 14 is more of the insulator 13 which was deposited later.

The top layer is the upper pole piece layer 15 which is curved down to the left to form a throat 12 and a gap 16 for reading a magnetic recording medium. Pole piece 15 curves down to the right to join pole piece 11 at "back gap" 28. The upper pole piece 15 can be deposited by evaporating a thin layer of metal upon insulator 13 and the remainder of the substrate, applying a resist mask and then electroplating through the mask onto the metal. Subsequently, areas not required are removed by resist and etching techniques. What is of interest here is that because of the topography of pole piece 15, the electroplating in areas 21, 22, 23, 24 and 25 can produce different alloys from the same plating bath solution when using previously known baths to produce 79:21 to 81:19 Ni:Fe alloys, for example.

Figure 1B:
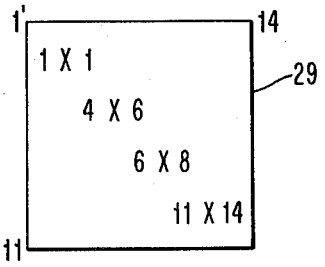
FIG. 1B shows in schematic form the general arrangement of 154 thin film, batch fabricated magnetic recording heads deposited on a silicon chip with eleven horizontal rows and 14 vertical columns of magnetic recording heads with four samples selected by row and column as indicated.
Figure 1C:
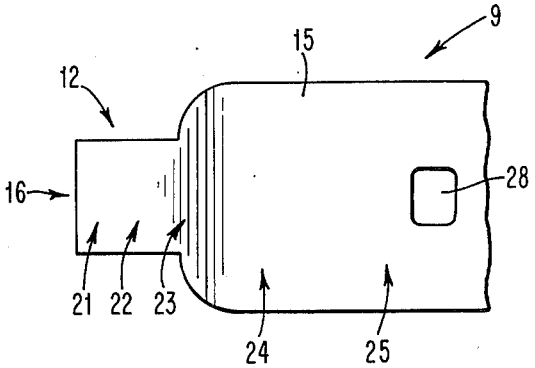
FIG. 1C shows a plan view of the head of FIG. 1A.

Reference to FIG. 1C shows the structure of pole piece 15 shown looking down on the top of pole piece 15.

Problem of Plating Uniformity

Figure 2:
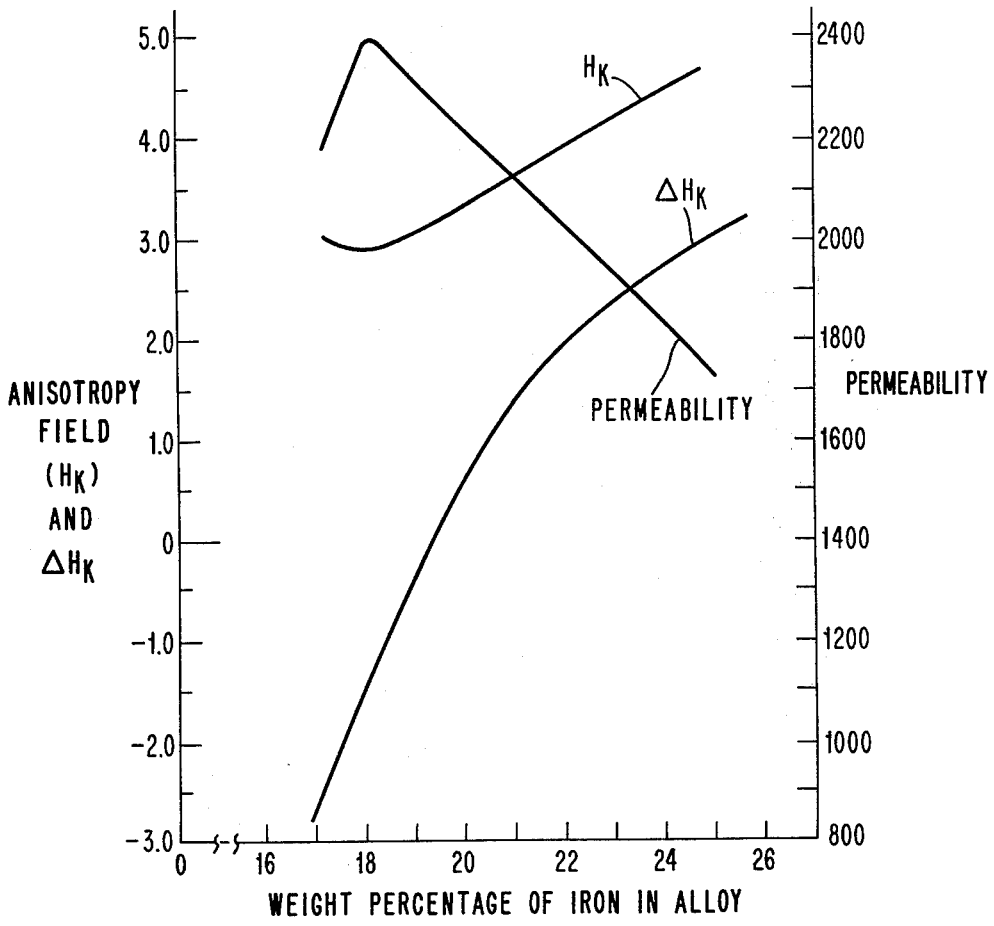
FIG. 2 shows the variations in values of anisotropy field $H_k$ as well as its incremental charge $\Delta H_k$ and the permeability as a function of the weight precentage of metal in the plated alloys produced by a "High Current Density" (HCD) bath.

In running tests on a thin film magnetic head 9, it was observed that the sides of the B-H loops at high drive fields were not vertical as expected. This phenomenon was assumed to be due to the presence of different magnetic phases in the plated films 11 and 15. This assumption was verified with the aid of x-ray fluorescence and permeability measurement. It was found that the plated film 11 and 15 had a compositional gradient in the direction of movement of a paddle used to stir the plating bath during the plating process. Compositional analysis of the Permalloy elements in the film heads 9 was performed using an electron microprobe. It was found that the upper pole piece layer 15 exhibited localized nonuniformity. The material in the pole tip region of throat 12, especially at the edge of the curvature corresponding to the zero throat height in area 22 was iron poor. Compositional uniformity is very critical to the magnetic properties and FIG. 2 gives the relationship for what we will refer to as a "High Current Density" (HCD) bath between composition of a plated film and various magnetic parameters. Compositional variation across the wafer, compounded by a compositional gradient along the head element, could very significantly affect head performance. Hence, it is imperative to minimize this gradient, not only across an element but across the entire wafer as well.

Solution to Problem

There are several factors that affect composition of a plated film. The variation in current density during plating is very significant in its effect upon composition of the alloy. Changing the bath composition by reducing the total dischargeable ions in solution and performing the plating at a very low current density was discovered to permit plating films with a minimal compositional gradient of the alloy. The differences in the composition of the Permalloy alloy across the pole pieces were reduced from 6–7% for HCD baths down to less than 2% overall within a device and diagonally across the wafer for the low current density LCD bath. The magnetic transducers made by the LCD bath had a better reading and writing stability and a better reproducibility than the transducers made from the HCD bath.

Table I shows the compositional makeup of two LCD baths compared to the higher dischargeable ion concentration of the HCD bath and a bath disclosed in U.S. Pat. No. 4,102,766. It should be noted that no surfactant is added to the LCD baths and that the concentrations of nickel and iron salts are decreased below those in both other baths. The primary function of a surfactant in an electrolyte is to act as a wetting agent and to prevent hydrogen bubbles formed during plating from adhering to the cathode surface. The wetting characteristics of the wafer surface have been improved very significantly by "ashing" the wafer surface prior to plating rather than adding surfactant to the bath. The plating cell used is a modification of the cell shown in U.S. Pat. No. 4,102,756. The plating cells comprise a rectangular PVC tark, a cathode that holds six substrates placed at the bottom of a cell, and an anode made of nickel placed at the top. The distance between the anode and the cathode is 3.5 cm. Both the anode and the cathode fill the cell from wall to wall in each direction. The bath is agitated over the cathode area by a paddle which moves back and forth over the surface of the cathode at an approximate distance of 2 to 3 mm. The rate of agitation is maintained at 1 cycle per second. Fresh solution is pumped in between the cathode and the anode at a rate of 1–10 liters per minute. The bath volume is 200 liters. The reason for this large volume of a bath is to provide stability and reproducibility between plating processes. The parameters for the three different plating process are given in Table II with two sets of LCD values, LCD-A and LCD-B.

Figure 3:
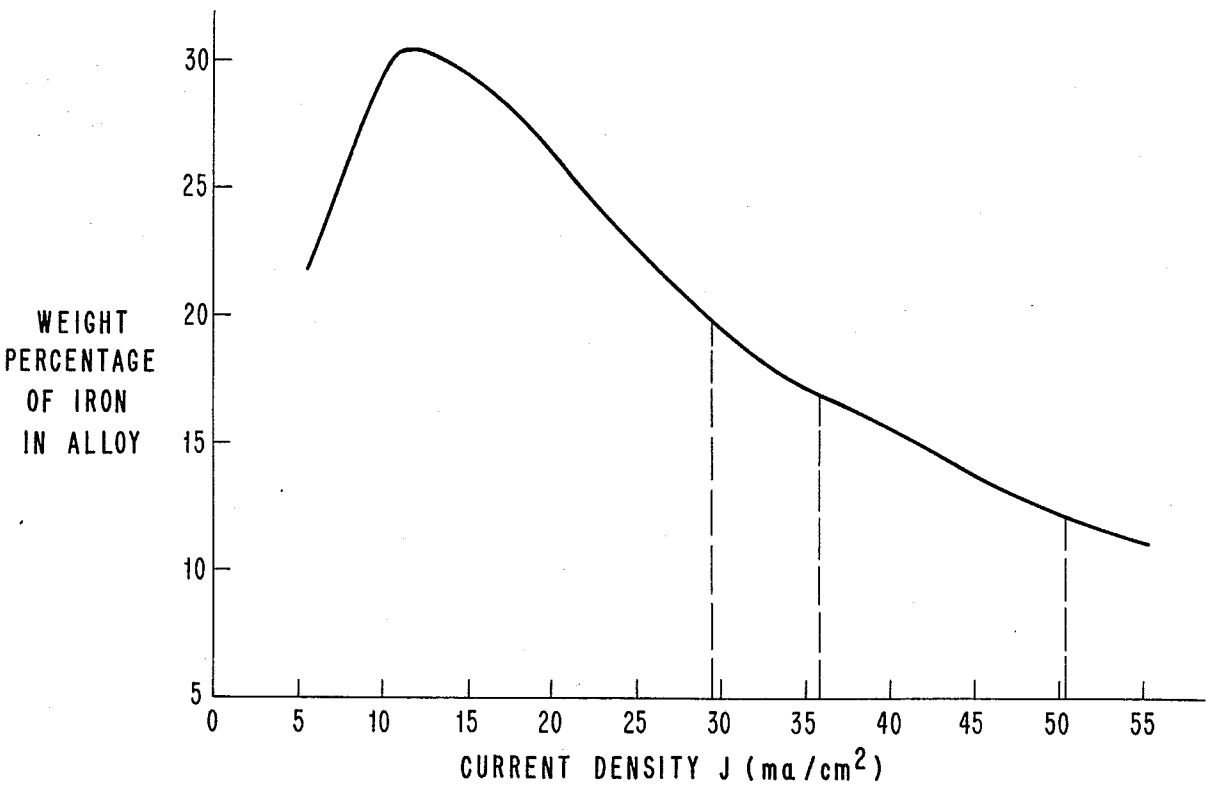
FIG. 3 shows the weight percentage of Fe metal by weight in the alloys produced by a HCD bath as a function of plating current density per unit area.

Table III gives the compositional variation across the element (upper pole piece 15 of head 9) and along the diagonal of the wafer 29 in FIG. 1B for the HCD bath. The average composition difference between points 22 and 23 on the element is 6.4% whereas the compositional gradient along the diagonal of the wafer 29 is 4.6%. The reason for this large percentage variation in Fe composition in the alloy as can be clearly seen from FIG. 3 which is a plot of the weight percentage of Fe in the alloy of the plated film versus the current density J for the HCD bath. The slope of the curve is very steep, thus a small change in current density J such as that caused by the geometry of the element gives rise to a moderate fluctuation in the composition of the plated material. The compositional difference between points 22 and 23 in FIG. 1C on the element shows a change in composition which is equivalent to the composition which would be produced by an overall change of 58% in current density. However, the change is not entirely attributable to current density change but it is also significantly influenced by diffusion layer thickness. At high current densities the topography variations cause variations in diffusion layer thickness which are reduced at lower current densities.

Figure 4:
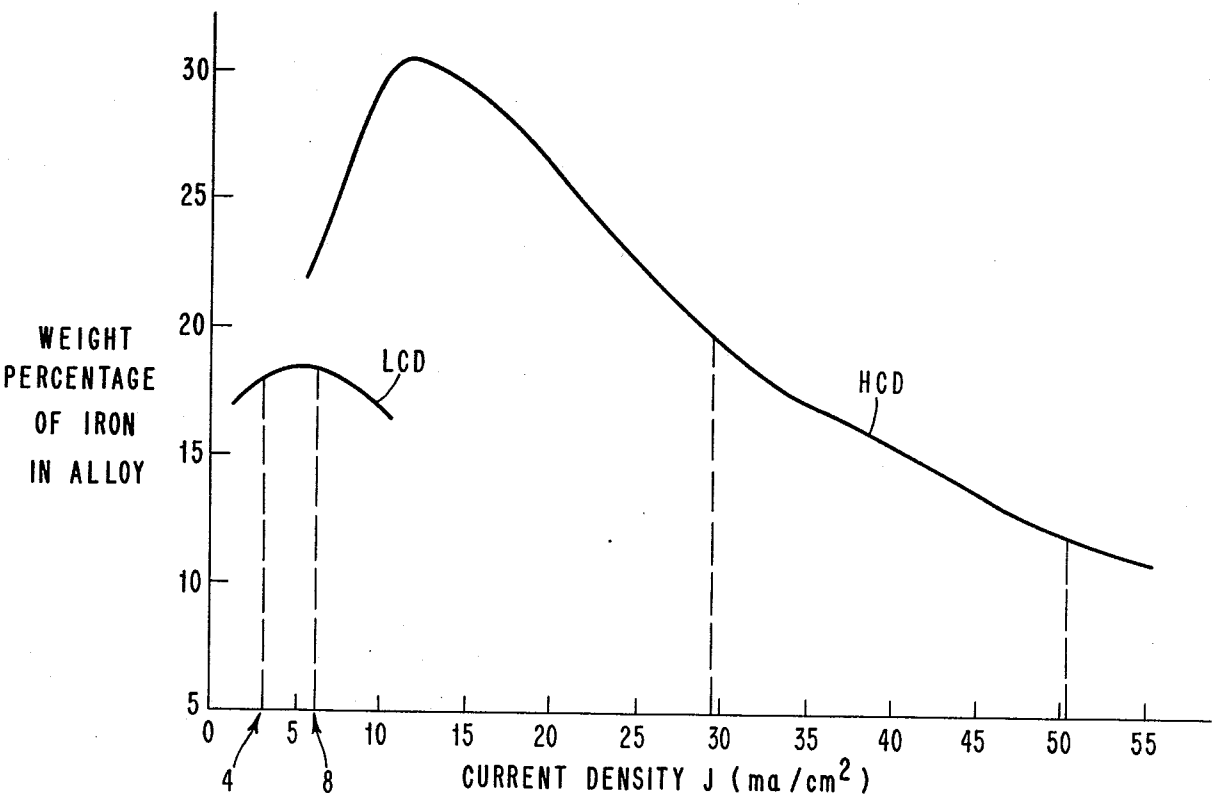
FIG. 4 shows the curve of FIG. 3 compared with a "Lower Current Density" (LCD) bath employed in accordance with this invention.

FIG. 4 is a plot of the composition of the plated nickel-iron alloy versus the current density for the LCD-A bath and for the HCD bath. Using the LCD-A bath, a 100% variation in current density from 4 milliamps to 8 milliamps per square centimeter produces about only a very small 0.5% change in composition. This range of current density values can be expected between points 22 and 23 of the element in FIGS. 1A and 1C under such conditions. The LCD-A bath yields a far superior compositional uniformity between the yoke and pole tips region of each transducer and between transducers over the entire wafer.

Table IV gives the electron microprobe compositional analysis of points 22 and 23 of an element for all six wafer positions in a cathode along its diagonal. In Table V, positions 1–6 in a square wafer were in three horizontal rows as follows:

| | |
|---|---|
| 1 | 2 |
| 3 | 4 |
| 5 | 6 |

Table IV gives the effect of compositional uniformity across an element on its unsaturated inductance value.

With the LCD-A bath, a substantially constant nickel-iron alloy ratio can be maintained over a range of current density values on complex shapes such as the pole pieces for thin film magnetic head elements. A low current density J of from 5 to 10 milliamps per centimeter squared minimizes the diffusion on layer and current density distribution effects to obtain a deposit of uniform composition over a topographical excursion. The critical aspects of the plating bath are the combination of the relatively low total quantity of dischargeable metal ions in the bath and the slow deposition rate attained by placing at a low value of current density J. The repeatability of composition is a function of the current density and the total salt content of the dischargeable species.

The actual LCD bath composition is not critical; that is, rather broad ranges of $Ni^{++}$ and $Fe^{++}$ as shown for the LCD-B bath can be used as well as different ratios of $SO_4^-$ to $Cl^-$. What is critical is the combination of the concentration of total dischargeable metal ions ($Ni^{++}$ and $Fe^{++}$) and the slow deposition rate attained by low current density (LCD) plating.

Figure 5:
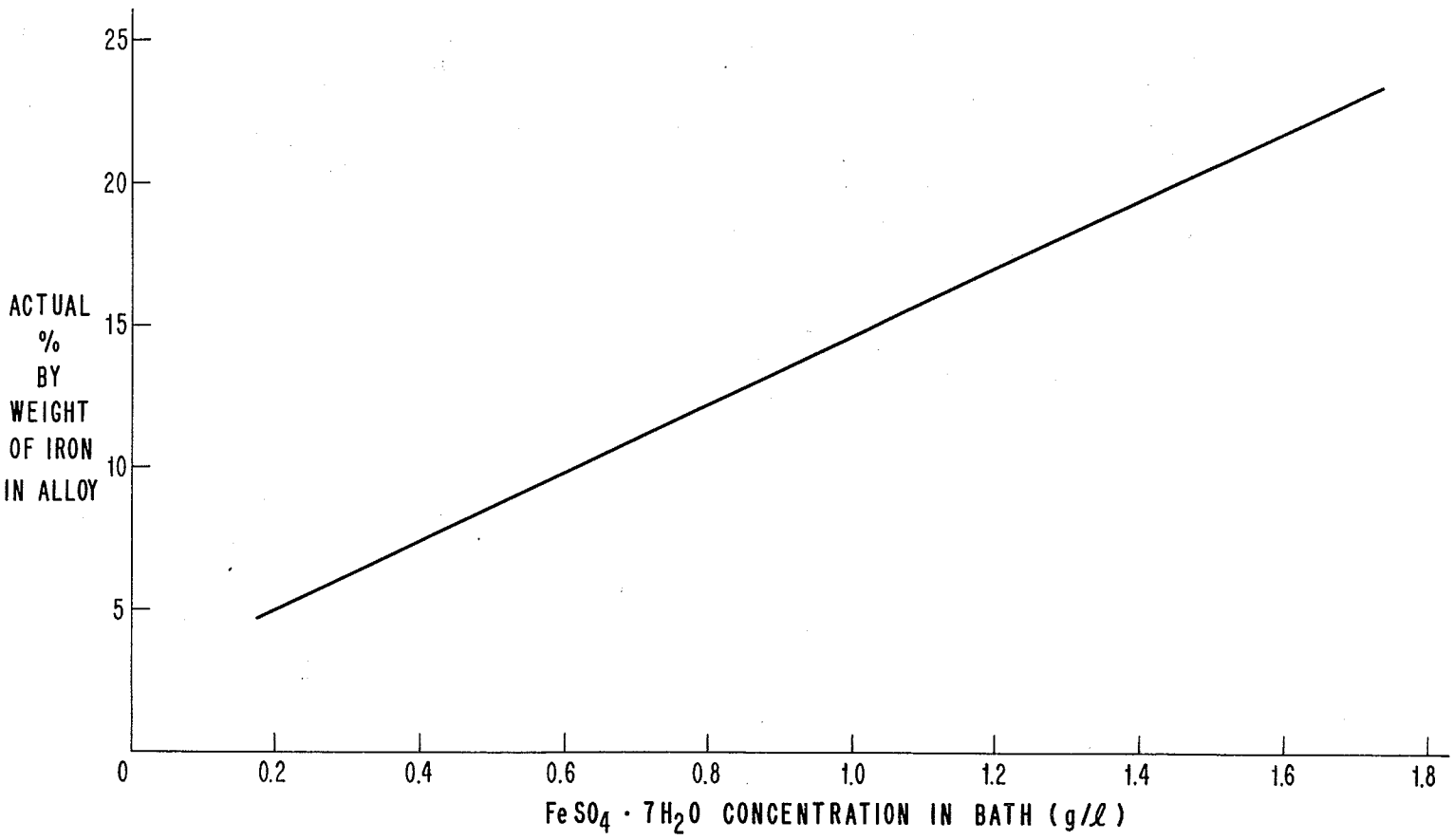
FIG. 5 shows a curve of the weight percentage of Fe metal in a plated deposit as a function of the number of grams per liter of $FeSO_47H_2O$ in a bath near the conditions in Table I for the LCD-B bath within a range of values of $FeSO_4$.

The specific formulation referred to as the LCD-B bath not only produces uniform compositions but also a highly repeatable overall range of compositions. See FIG. 5 with a slope of 1.15 wt.% Fe in deposit/0.1 g/l $FeSO_4$ at stated conditions and a range of 0.2–1.7 g/l $FeSO_4.7H_2O$ which comprises a range from 0.04–0.3417 g/l of $Fe^{++}$ ions which can also be in solution with anions such as $Cl^-$. Analysis of FIG. 5 shows that one can secure 5% Fe at 0.2 g/l $FeSO_4.7H_2O$, (0.04 g/l $Fe^{++}$); 10% Fe at 0.6 g/l $FeSO_4.7H_2O$, (0.12 g/l $Fe^{++}$); 15% Fe at 1.04 g/l $FeSO_4.7H_2O$, (0.21 g/l $Fe^{++}$); and 20% Fe at 1.45 g/l $FeSO_4.7H_2O$ (0.29 g/l $Fe^{++}$).

The current density required to discharge an alloy of 81:19 Ni:Fe or other desired composition is primarily a function of the ratio of Ni:Fe in the bath. We have found the repeatability of deposit composition from run to run is a function of the current density and total salt content of dischargeable species ($Ni^{++}$ and $Fe^{++}$). This is best summarized in Table VII.

The mid-Ni and high Ni baths show the low current density (LCD) deposition is responsible for the topographical compositional uniformity while the low salt content is the prime contributor to repeatability.

A comparision of a deposit from the LCD-B bath and a deposit from the HCD bath is shown in the following manner. For ion microprobe compositional analysis of pole piece layers 11 and 15 of actual head elements fabricated from the above bath, see Table VII. The HDC baths yield about 5–7% gradients in most case applications for probe piece 15 where the LCD-B bath yields about a 2% gradient.

Low Current Density Permalloy and Batch A

Introduction

The two most obvious differences between the thin film inductive heads whose magnetic elements are deposited by sputtering or plating from the HCD NiFe baths are;

(1) the recording properties of the sputtered films are significantly more uniform across the substrate; and (2) the sputtered film heads display lower read amplitudes. The first is attributed to compositional uniformity inherent in the sputtering process, the second, to the presence of a higher anisotropy field ($H_k$) in the sputtered films relative to plated films which results in a lower permeability at a given moment ($4\pi$ Ms).

The work reported in this section is aimed at producing electrodeposited elements of compositional uniformity significantly improved over the routine HCD deposits, particularly in the vertical excursions from planar encountered in the fabrication of pole piece layers 15.

This section is divided into three parts; (1) a comparison of composition gradients in pole piece 15 deposits from LCD and HCD; (2) a comparison of the thickness distribution in batch A compared to batch B; (3) a description of the fabrication of batch A.

Discussion

A comparison of the compositional distribution of NiFe from the HCD NiFe and the LCD baths in pole piece 15 configuration is tabulated in Table IX, the code locations 21–26 for test site are shown in FIGS. 1A and 1C.

It is obvious from Table IX that lower current densities promote greater uniformity in composition in our worst case application, which is deposition of upper pole piece 15.

Table X presents the second benefit of the LCD bath; namely, improved thickness uniformity. The table is a comparison of the statistical analysis of "Lasetek" data collected from batch B wafers 740 and 744, (normal process, other member of B used various current densities) and batch A (wafers 831, 832, 833). Batch B's magnetic layers were deposited at 26.9 ma/cm$^2$ from the HCD bath, while A was fabricated at 10 mA/cm$^2$ from the LCD bath. Note that for batch A the pole piece thickness variations are less that $\pm 10\%$ at $3\sigma$. The thickness distribution for batch B on a per wafer basis is not as poor as the conbined data indicates (20–30%, $3\sigma$).

With the exception of the electrodeposition of the magnetic layers, the fabrication of batch A preceded as for a routine inductive device. The magnetic layers or the object of interest in batch A were plated in a two-wafer fixture using an eight liter LCD NiFe bath developed for the purpose of providing improvement in thickness and compositional uniformity of the Permalloy alloy layers.

To summarize, with this invention operation of a NiFe electroplating bath in a manner, in which current density is not a critical controlling factor in determining the composition of a deposit, permits the deposition of films of excellent compositional uniformity over entire plating fixtures as well as over complex topographical patterns. This is of major importance as it now permits the fabrication of upper pole piece layers 15 of thin film heads 9 with excellent compositional uniformity.

Figure 6:
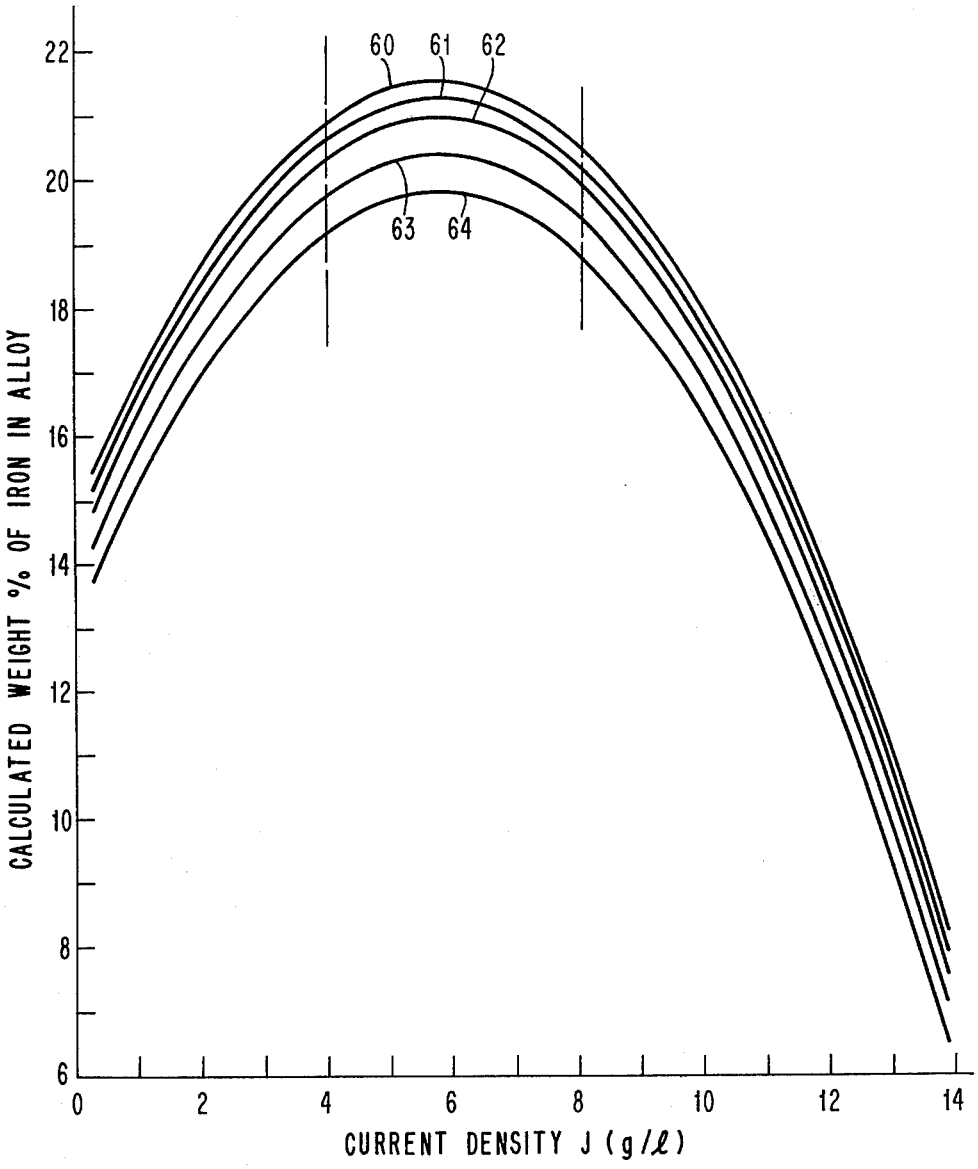
FIG. 6 shows a calculated simulation of the weight percentage of Fe in a deposit from an LCD bath as a function of current density. The simulation is based upon data generated from an equation based upon a first equation developed from a regression analysis of actual data

In FIG. 6 a simulation of %Fe in the deposit as a function of current density is plotted at various levels of NaCl content. The equation used to generate these curves was derived by regression analysis of the data collected for 76 runs of LCD baths at various levels of $Ni^{++}$ ions, $FeSO_4.7H_2O$, NaCl content run at various current densities measuring the response (weight %Fe) by atomic absorption analysis of the deposited films. These runs were made in a plating cell described above with pH=3.0 at a room temperature value of 23°–24° C., and an agitator velocity equal to 1 cycle/sec. Curves 60–64 are made for increasing concentrations of NaCl in grams per liter of 0, 17.5, 25, 50 and 100 in that order, using 1.5 g/l $FeSO_4.7H_2O$ and 13.3 g/l $Ni^{++}$.

The bath simulated 13.3 g/l Ni (0.226 M), 1.5 g/l $FeSO_4.7H_2O$ (0.054 M) was used at 10 ma/cm$^2$ as LCD-B to fabricate batch A. The improved uniformity obtained is clearly presented below in a section entitled "Low Current Density Permalloy and Batch A".

Figure 7:
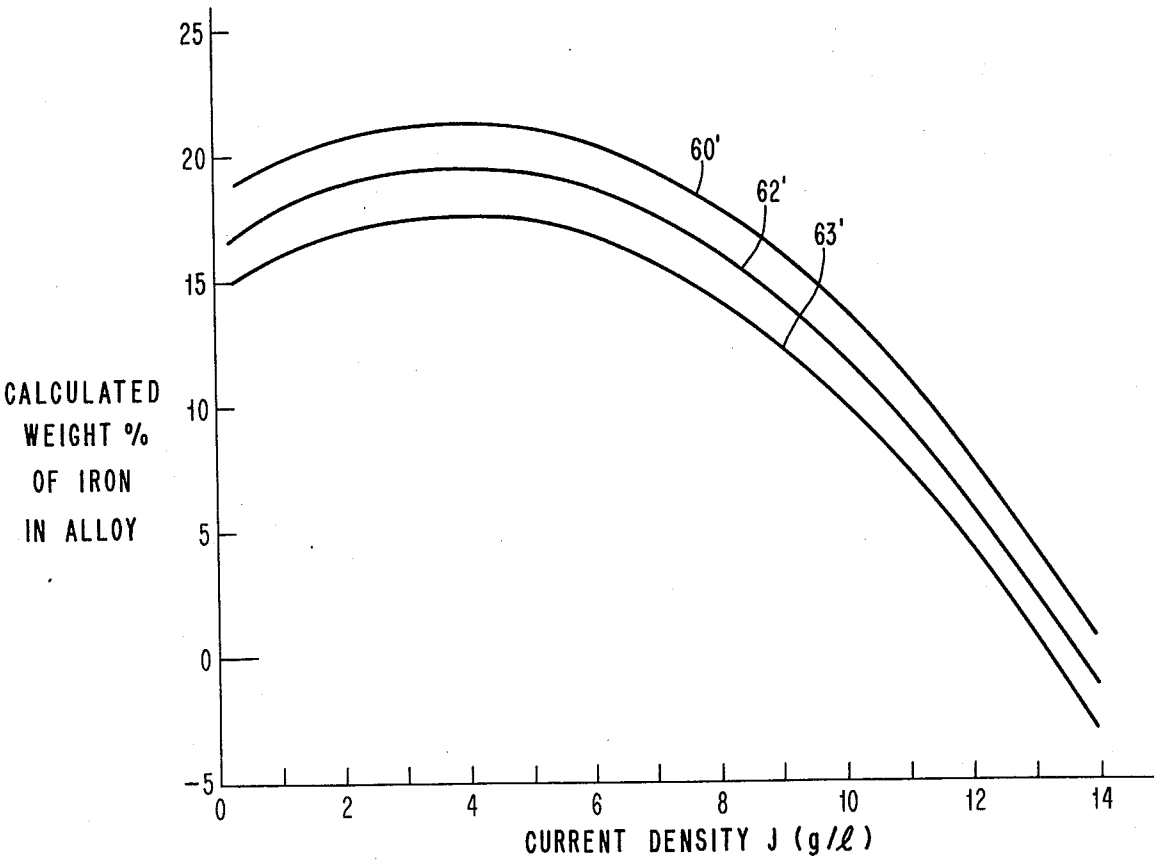
FIG. 7 shows a similar set of curves to those of FIG. 6 for reduced $Fe^{++}$ and $Ni^{++}$ ion cncentrations in the bath.

Obviously, the regression equation obtained above is not exactly correct, as a quick look at FIG. 7 will reveal, one could hardly expect to obtain negative iron contents. However, the area of interest was still indicated to be about 5 ma/cm$^2$, and the values of Fe content of about 18% are desirable. In this case, the $FeSO_4.7H_2O$ concentration is down by $\frac{1}{3}$ to 1.0 g/l and the $Ni^{++}$ concentration is down to 12.0 g/l. The values of NaCl are 0,25, and 50 g/l for curves 60', 62' and 63' respectively.

Figure 8:
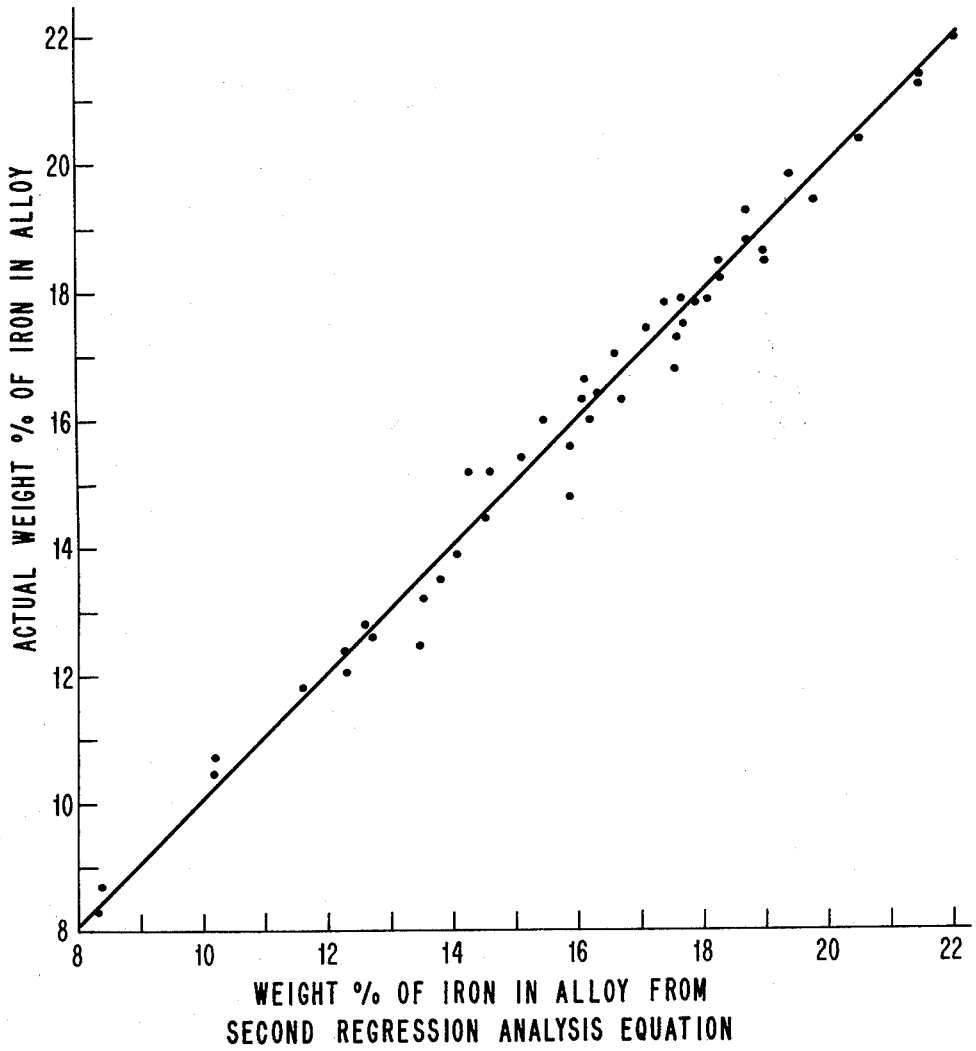
FIG. 8 shows a sample of a comparison of the actual measured weight percentage of Fe in films by actual analysis versus the values of Fe in films calculated using a formula described below in connection with the discussion of FIG. 8 which is a second regression analysis equation.
Figure 9:
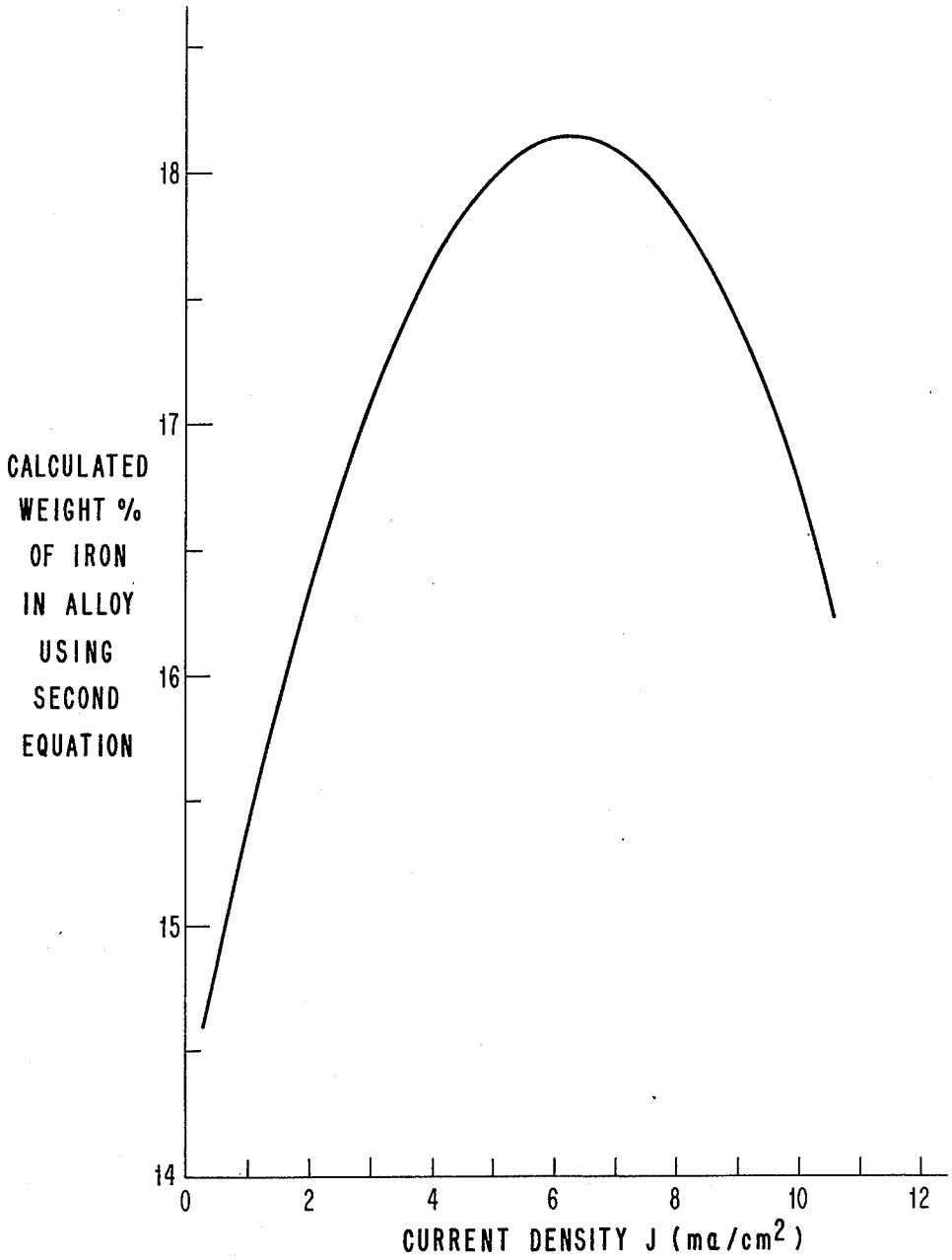
FIG. 9 shows a curve of the simulated, calculated values of the weight percentage of Fe in a film versus current density J, for slightly more $Fe^{++}$ in solution than in FIG. 7, with the same NaCl concentration as in the middle curve.
Figure 10:
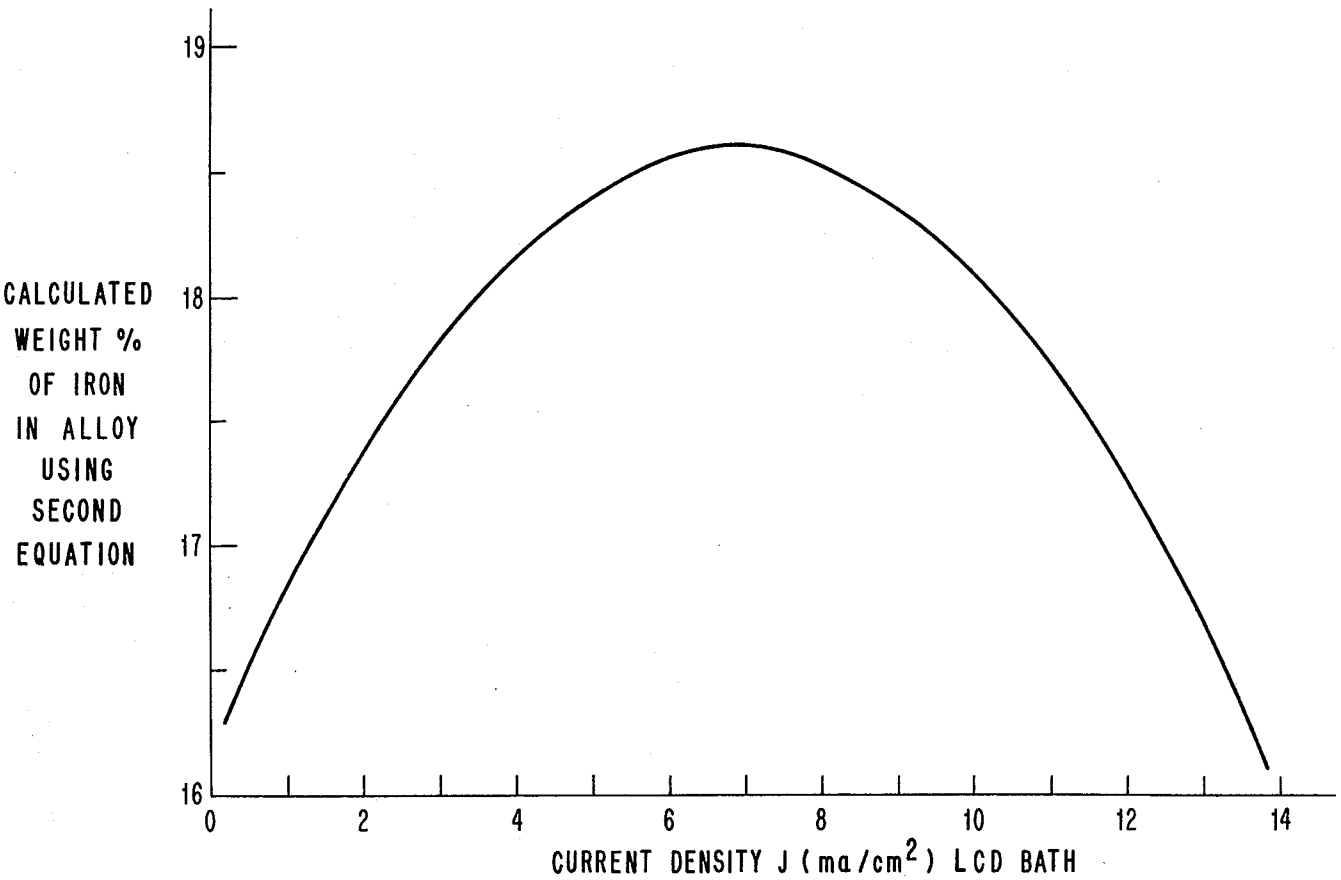
FIG. 10 shows a similar curve to that of FIG. 9 for a slightly increased $Fe^{++}$ in concentration and the maximum Fe film percentage content by weight is increased accordingly.

A second regression equation, FIG. 8, was derived from data collected on 144 LCD runs. The equation used was $X(\%Fe \text{ in film}) = 106 - 12.6\,(Ni^{++}\ g/l) + 5.39\,(Fe^{++}\ g/l) \times J\ ma/cm^2 - 0.1\ J^2\ (ma/cm^2)^2 + 0.41\,(Ni^{++}\ g/l)^2$. This resulted in the basic formulation LCD as seen in FIG. 9 for values of $FeSO_4.7H_2O$ of 1.15 g/l for $Ni^{++}$ of 12 g/l and for NaCl of 25 g/l. In another simulation comparison, FIG. 10 shows the improved product of regression analysis on 184 films from LCD runs for values of $FeSO_4.7H_2O$ of 1.2, $Ni^{++}$ of 12 g/l and NaCl of 25 g/l and high (27 ma/cm$^2$) runs.

Figure 11:
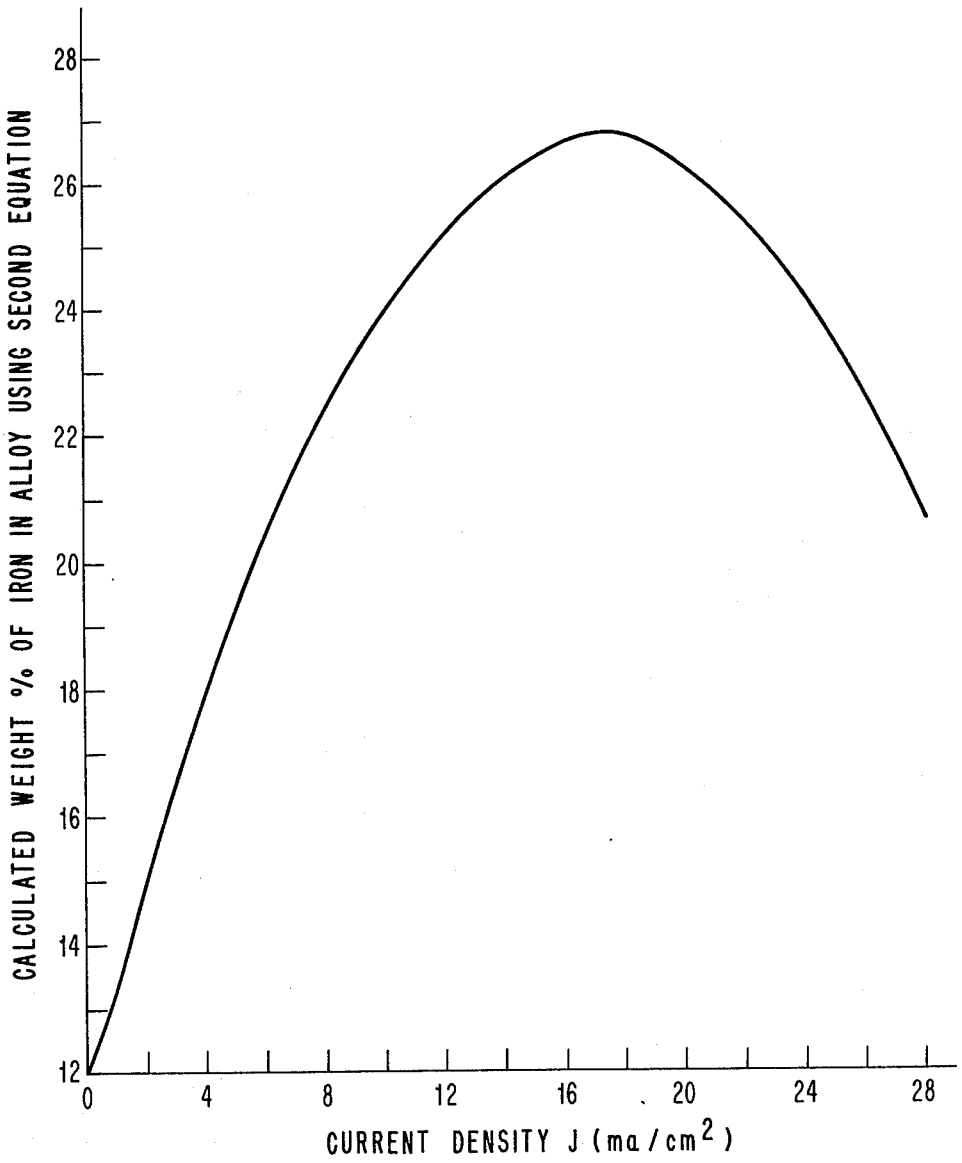
FIG. 11 shows a similar regression analysis simulation plot to those shown in the preceding FIGS. but for a "HCD" bath with a far higher $Fe^{++}$ concentration and higher $Ni^{++}$ concentrations with no salt.

FIG. 11 shows a similar curve for an HCD bath with 3.0 g/l $FeSO_4.7H_2O$, 14.5 g/l $Ni^{++}$ and 0 g/l NaCl.

The simulation of the HCD bath used at about 29 ma/cm$^2$ reveals one of the reasons behind the compositional gradients observed in the upper pole piece 15 structure in FIG. 1A, local current density gradients. This combined with differences in the diffusion, or depletion, layer thickness as a result of agitation differentials caused by vertical topographical excursions from planar result in gradients as high as 5 weight %Fe between zero throat height and the bulk of pole piece 15 over the conductor pattern in Table VIII. The use of LCD baths and operating parameters reduce this to 1% Fe or less.

The actual composition of the deposit from a NiFe bath is fundamentally dependent on the thickness of the diffusion layer (or depletion zone formed by ions in the area above the cathode). Diffusion layer thickness is dependent on the degree of agitation and current density. The latter is the producer of polarization and permits deposition to occur.

Taking the plot of FIG. 6 for HCD values of $FeSO_4.7H_2O$ of 3 g/l, $Ni^{++}$ of 14.5 g/l and NaCl of zero as a starting point, the following table shows "what if:"

| What if we: | Then: |
|---|---|
| Reduce current density from 6–2 or less ma/cm$^2$ | Other than deviating from a desirable (magnetically) composition, the reproducibility of deposition rates and hence uniformity of thickness would be adversely affected as more and more potential goes into production of $H_2$ as opposed to metal. |
| Increase current density above about 10 mA/cm$^2$ | The deposition begins to take on the diffusion limited response to local current density effects, hence non-uniformity begins to be a problem. |
| Change the $Ni^{++}$ content of the bath | The general shape of the curve would be unchanged, only shifting inversely to the Ni content change. |
| Change the $Fe^{++}$ content of the bath | The general shape would remain but the area of min d(Fe)/d(ma/cm$^2$) would shift upward to the right or downward to the left for an increase or decrease respectively. |

The overall composition of a deposit from a NiFe plating bath is apparatus sensitive. This is due to slight differences in the apparatus construction. Thus, duplication of the bath and apparatus used in this work will probably not produce identical deposits without adjustments to the operating current density and/or the $Fe^{++}$ ion concentration.

SUMMARY

The composition gradients associated with the electrodeposition of NiFe over vertical topography can be eliminated by using low current density deposition in a region of operation where the current density is not the controlling parameter for composition of the deposit.

The elimination of compositional gradients in the structure of upper pole piece layer 15 is the single largest contributing factor to the reduction of the read signal "wiggle" problem and improved overall performance of thin film inductive heads recently produced.

Figure 12:
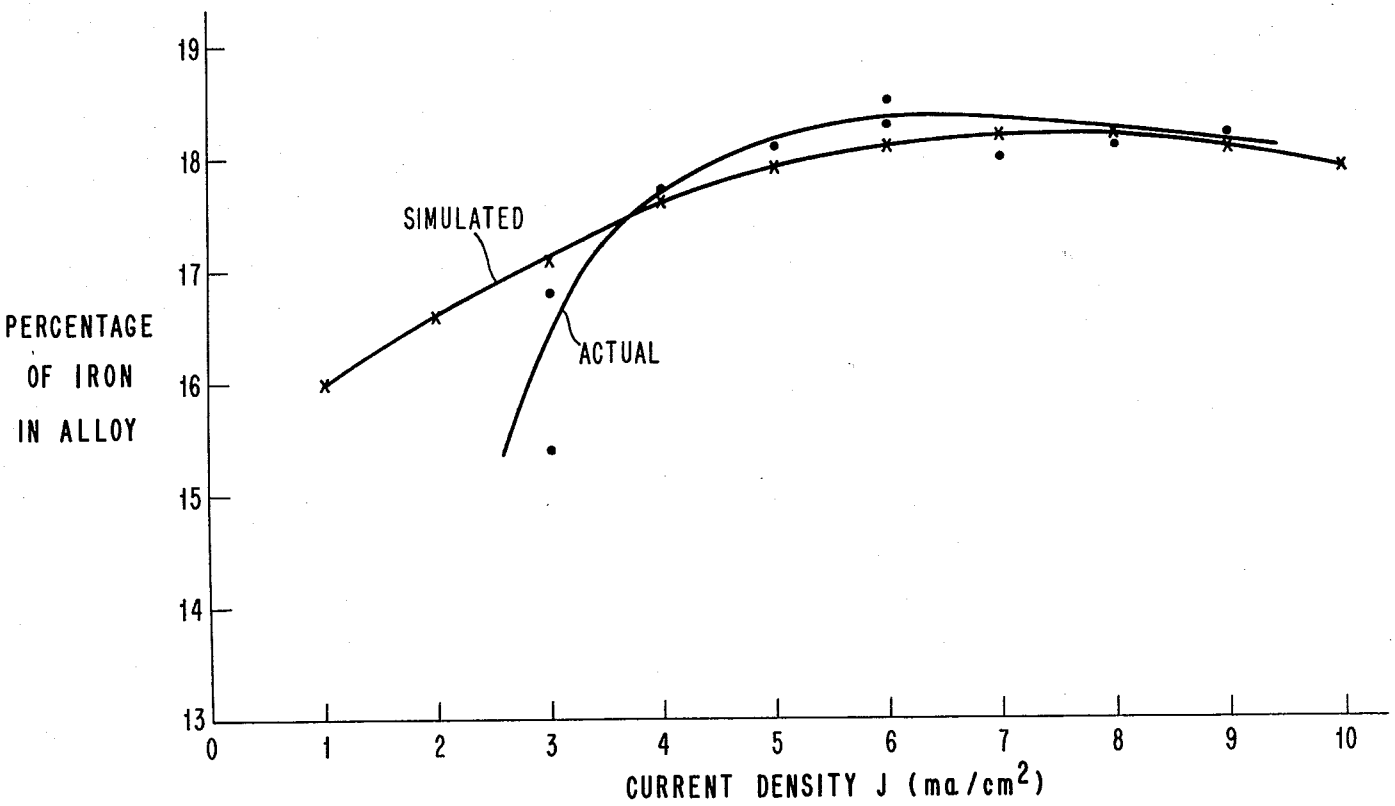
FIG. 12 shows another plot comparing simulated and actual values using the last in a series of regression analysis equations versus plating current density J.

A final regression analysis equation accounts for 85.1% of the total variation of the data for 183 samples. The equation is as follows: X(%Fe in alloy)$=0.457+24.18\ [Fe^{++}]-3.07\ [Ni^{++}]+0.45\ [NaCl]-1463.5\ [Fe^{+2}]+1.675\ [Fe^{++}]\times J-0.0005\ J^2+5.67\ [Ni^{+2}]-1.99\ [Ni^{+}]\times[NaCl]$, where $Ni^{++}$, $Fe^{++}$ and NaCl values are molar concentrations and J is the current density in ma/cm$^2$ as usual. FIG. 12 shows a plot similar to the calculated and actual weight percentages of iron in the alloy versus current density J. The modified LCD-A iron rich bath contained 12.5 g/l $Ni^{++}$, 1.31–1.34 g/l $FeSO_4.7H_2O$ and 25 g/l NaCl.

Figure 13:
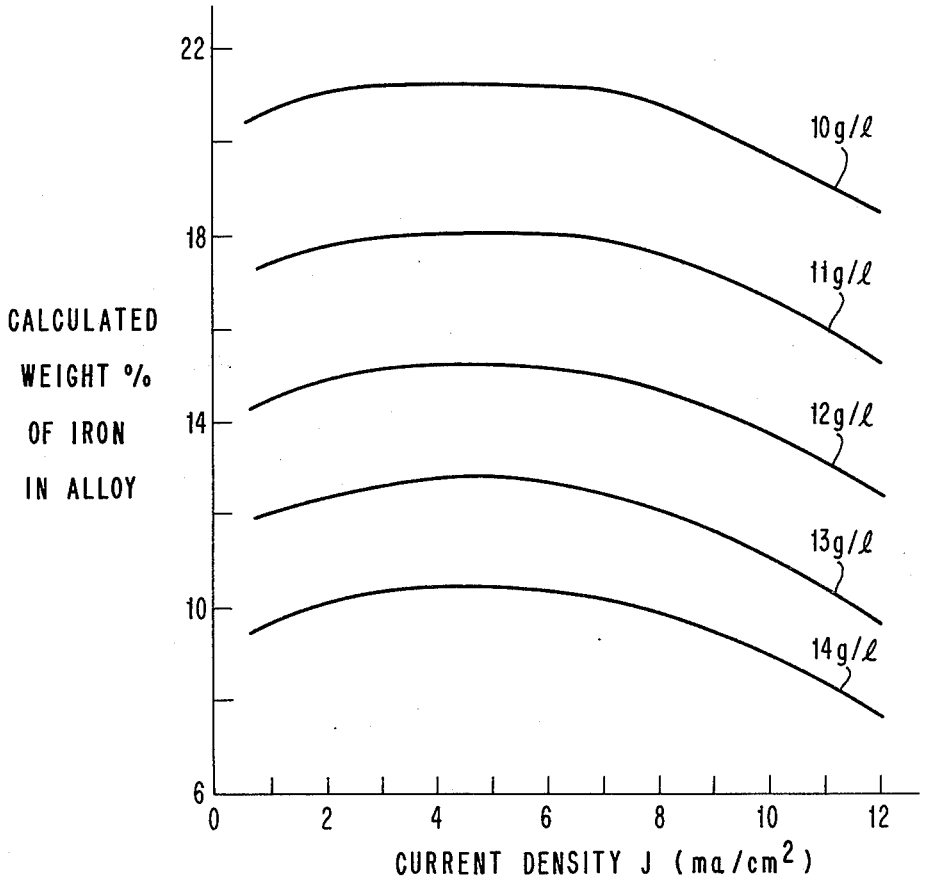
FIGS. 13 and 14 show calculated values of Fe percentage in an alloy as a function of current density J for several values of $Ni^{++}$ concentration in the bath.

FIG. 13 shows calculated percentages of Fe in the alloy versus current density J for five values of $Ni^{++}$ concentration in the bath at 0.8 g/l $FeSO_4.7H_2O$ and 25 g/l NaCl. The data was based upon the last regression analysis equation.

Figure 14:
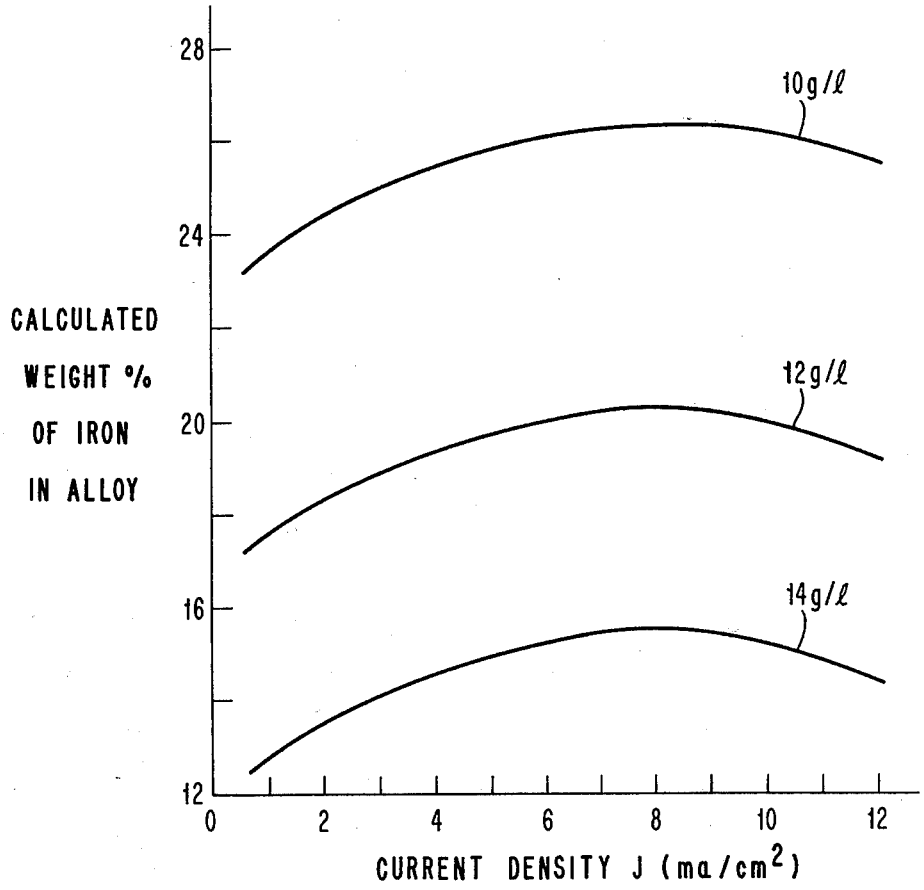

FIG. 14 is a similar set of curves to those of FIG. 13 for $Ni^{++}=10$, 12 or 14 g/l and 1.4 g/l $FeSO_4.7H_2O$ and 25 g/l NaCl.

FIG. 12 and simulations in FIGS. 13 and 14 show what analysis of actual data has shown, i.e., that in general the curves are most flat within the preferred range, between about 4 ma/cm$^2$ and 8 ma/cm$^2$. On the other hand, acceptable results are generally achieved in the range between about 2 ma/cm$^2$ and 12 ma/cm$^2$. It should be noted that in many cases below 3 ma/cm$^2$ hydrogen evolution becomes a problem and below 2 ma/cm$^2$ hydrogen evolution is so great that reliability and repeatability of plating is severely reduced.

Figure 15:
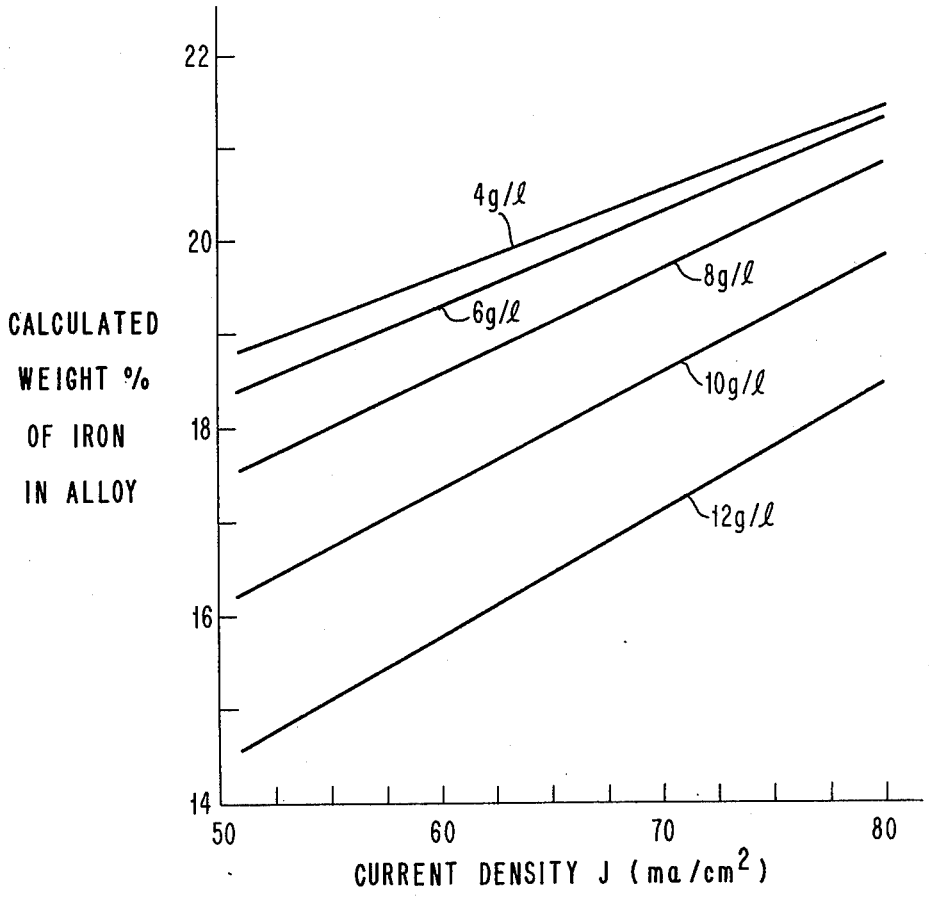
FIG. 15 shows calculated values of Fe percentage in an alloy as a function of current density J for several values of $FeSO_4.7H_2O$ concentration in the bath.

FIG. 15 shows how for any given current density and other bath constants held at identical values, i.e., with $Ni^{++}$ at 10 g/l and NaCl at 25 g/l, the percentage of iron in the alloy increases as a function of $Fe^{++}$ in the form of $FeSO_4.7H_2O$ in g/l in the bath, with percentages of Fe in the alloy decreasing with increasing current values.

TABLE I

| Alloy | 20 Fe:80 Ni HCD | 48 Fe:52 Ni U.S. Pat. No. 4,102,756 Table IV | 20 Fe:80 Ni LCD-A | LCD-B |
|---|---|---|---|---|
| Total $Ni^{++}$ | 13.7 g/l | 26.9 g/l | 12.4 g/l | 13.7 g/l |
| Total $Fe^{++}$ | 0.6 g/l | 0.42 g/l | 0.24 g/l | 0.2–0.3 g/l |
| Current Density (J) | 36 ma/cm$^2$ (25–32 ma/cm$^2$) | 5 ma/cm$^2$ (5–40 ma/cm$^2$) | 4 ma/cm$^2$ | 5–10 ma/cm$^2$ |
| $NiCl_2 . 6H_2O$ ($Ni^{++}$) | 39 g/l (9.7 g/l) | 109 g/l (26.9 g/l) | 35.3 g/l (8.7 g/l) | 39 g/l (9.7 g/l) |
| $NiSO_4 . 6H_2O$ ($Ni^{++}$) | 16.3 g/l (4 g/l) | — | 14.7 g/l (3.7 g/l) | 16.3 g/l (4 g/l) |
| $FeSO_4 . 7H_2O$ ($Fe^{++}$) | 3 g/l (0.6 g/l) | — | 1.2 g/l (0.24 g/l) | 1–1.5 g/l (0.2–0.3 g/l) |
| $FeCl_2 . 4H_2O$ ($Fe^{++}$) | — | 1.5 g/l (0.42 g/l) | — | — |
| pH | 2.8 ± .05 (3.0) | 2.5 | 3.0 ± .05 | 3.0 |
| $H_3BO_3$ | 25 g/l | 25 g/l | 25 g/l | 25 g/l |
| Sodium Saccharin | 1.5 g/l | 0.8 g/l | 0.75 g/l | 1.5 g/l |
| NaCl | 0 | 0 | 25 g/l | 0–50 g/l |
| Wetting Agent | 0.1 g/l | — | — | 0.1 g/l |
| Temperature °C. | 23° (30°) | 25° | 23° | 30° |

TABLE I-continued

| Alloy | 20 Fe:80 Ni HCD | 48 Fe:52 Ni U.S. Pat. No. 4,102,756 Table IV | 20 Fe:80 Ni LCD-A | LCD-B |
|---|---|---|---|---|
| Paddle Speed | 1 cps | 8"/sec | 1 cps | 1 cps |

TABLE II

| Parameters | HCD Bath | U.S. Pat. No. 4,102,756 Table IV Bath | LCD-A Bath |
|---|---|---|---|
| Temperature °C. | 23.0 | 25 ± 0.5 | 23.0 |
| pH | 2.8 ± .05 | 2.5 ± .05 | 3.0 ± .05 |
| Current Density ma/cm$^2$ | 36.0 (25–32) | 5 (5–40) | 4.0 |
| Paddle Speed | 1.0 cycle/sec. | 8"/sec. | 1.0 cycle/sec. |
| Plating Rate microns/sec. | 0.01196 (s) 0.01008 | (0.00083–0.5) | 0.00106 |

TABLE VI

Effect of Process Change on Unsaturated Inductance

| | | |
|---|---|---|
| (A saturated) Nanohenries | 71.9 (7)* | 99.8 (6)* |
| Permalloy | HCD | LCD |
| Max. Insulation Thickness Microns | 8 | 8 |
| Δ Composition % Fe | 5–7 | 0–1 |
| Composition % Fe | 17 (range 14%–21%) | 17 (range 16%–18%) |

*(Standard Deviation)
Δ Composition is the difference in values of composition at points 22 and 23 on a head.

TABLE III

Element Composition Analysis for Wafer from HCD Bath

| Location on Wafer (FIG. 1B) | 1 × 1 | 4 × 6 | 6 × 8 | 8 × 10 | 11 × 14 |
|---|---|---|---|---|---|
| Location on Element (FIGS. 1A–1C) | 21 22 23 24 | 21 22 23 24 | 21 22 23 24 | 21 22 23 24 | 21 22 23 24 |
| % Iron | 17.2 14.9 19.7 20.9 | 15.4 12.3 19.6 19.2 | 14.9 12.0 19.5 18.4 | 14.8 12.7 18.8 18.5 | 13.0 10.0 16.2 15.1 |
| Difference Btwn. Pt. 22 and Pt. 23 | 4.8 | 7.3 | 7.5 | 6.1 | 6.2 |

TABLE IV

Element Composition Analysis on Wafer from LCD Bath

| Location on Wafer FIG. 1B | 1 × 1 | 4 × 6 | 6 × 8 | 8 × 10 | 11 × 14 |
|---|---|---|---|---|---|
| Location on Element (FIG. 1A) | 21 22 23 24 | 21 22 23 24 | 21 22 23 24 | 21 22 23 24 | 21 22 23 24 |
| % Iron | 20.6 21.0 21.0 21.2 | 19.7 20.0 20.1 20.1 | 19.2 19.5 20.0 20.5 | 19.0 19.9 20.0 20.0 | 20.6 21.1 21.2 21.8 |
| Difference Btwn. Pt. 22 and Pt. 23 | 0 | 0.1 | 0.5 | 0.1 | 0.1 |

TABLE V

LCD Bath Composition Analysis on Six Position Cathode

| Cathode Position | Element Location on Wafer (FIG. 1B) 1 × 1 22* | 1 × 1 23* | 4 × 6 22* | 4 × 6 23* | 6 × 8 22* | 6 × 8 23* | 8 × 10 22* | 8 × 10 23* | 11 × 14 22* | 11 × 14 23* | Av. Fe % | Maximum Difference in % Fe Within El. | Maximum Difference in % Fe Across Wafer |
|---|---|---|---|---|---|---|---|---|---|---|---|---|---|
| 1 | 17.0 | 17.4 | 17.3 | 17.6 | 17.5 | 17.3 | 17.8 | 17.3 | 17.8 | 17.7 | 17.4 | 0.4 | 0.8 |
| 2 | 17.6 | 17.4 | 17.6 | 17.5 | 17.4 | 17.4 | 17.8 | 17.4 | 17.8 | 17.7 | 17.4 | 0.4 | 0.4 |
| 3 | 18.2 | 18.0 | 17.8 | 18.1 | 17.9 | 17.9 | 17.8 | 17.8 | 17.6 | 17.8 | 17.9 | 0.3 | 0.6 |
| 4 | 17.5 | 17.9 | 18.2 | 18.0 | 18.2 | 17.9 | 18.0 | 18.2 | 18.8 | 18.5 | 18.1 | 0.4 | 0.8 |
| 5 | 18.2 | 18.6 | 18.3 | 18.2 | 17.5 | 17.1 | 17.7 | 17.6 | 17.8 | 18.0 | 17.9 | 0.4 | 1.5 |
| 6 | 18.0 | 17.8 | 17.5 | 17.5 | 17.0 | 17.4 | — | — | — | — | 17.5 | 0.4 | 1.0 |

*FIGS. 1A and 1B

TABLE VII

| Bath | Molar Concentrations $NiSO_4$ | $NiCl_2$ | $FeSO_4$ | Ni/Fe wt. % | Current Density (ma/cm$^2$) | Uniformity of Composition | Repeatability of Composition |
|---|---|---|---|---|---|---|---|
| HCD | 0.062 | 0.164 | 0.0108 | 20.9 | 26.9 | fair | very good |
| LCD-B | 0.062 | 0.164 | 0.00504 | 41.8 | 10.0 | excellent | excellent |
| Mid-Ni | 0.183 | 0.492 | 0.0129 | 52.3 | 10.0 | excellent | fair |
| High Ni | 1.00 | 0.210 | 0.0252 | 48.0 | 5.0 | excellent | poor |

TABLE VIII

| | | | Wt. % Ni at Site | | | | | |
|---|---|---|---|---|---|---|---|---|
| | | | Pole Piece 15 | | | | Pole Piece 11 | |
| Batch # | Wafer # | Bath | 22 | 23 | 24 | 25 | 26 | 27 |
| B | 830 | HCD | 84 | 78 | 84 | 84 | 79 | 80 |
| A | 831 | LCD | 81 | 81 | 80 | 80 | 80 | 80 |
| | 832 | " | 81 | 80 | 79 | 79 | 79 | 79 |
| | 833 | " | 82 | 82 | 81 | 81 | 81 | 81 |
| C | 838 | HCD | 81 | 80 | 77 | 76 | 81 | 80 |
| D | 3148 | " | 89 | 89 | 84 | 82 | 83 | 84 |
| | 3149 | " | 87 | 86 | 84 | 82 | 81 | 84 |

TABLE IX

| Plating Bath Bath | Current Density ma/cm$^2$ | Wt. % Fe 28 | Sites (normalized) 24 | 22 |
|---|---|---|---|---|
| HCD-URC* | 26.9 | 15.4 (0.77) | 20.1 (1.00) | 18.2 (0.91) |
| HCD-Center | 26.9 | 19.5 (0.80) | 24.4 (1.00) | 22.7 (0.93) |
| Ni-¼-6-Center | 13.0 | 22.4 (0.87) | 25.7 (1.00) | 24/5 (0.95) |
| LCD-URC* | 10.0 | 20.3 (0.00) | 22.6 (1.00) | 23.1 (1.02) |
| LCD-Center | 10.0 | 19.0 (0.93) | 20.4 (1.00) | 21.3 (1.04) |

*upper right corner (URC)

TABLE X

| Layer | # Measurements | High | Low | Range | Mean | o | (3o/mean) × 100 |
|---|---|---|---|---|---|---|---|
| 11Center | 176 | 1.97 | 1.36 | 0.61 | 1.70 | 0.17 | 30% |
| 11 | 176 | 2.71 | 1.86 | 0.85 | 2.31 | 0.24 | 31.2 |
| 11 | 528 | 2.57 | 2.08 | 0.49 | 3.26 | 0.07 | 9.3 |
| 15Center | 352 | 2.20 | 1.42 | 0.78 | 1.99 | 0.15 | 22.6 |
| 15 | 176 | 2.86 | 2.14 | 0.72 | 2.62 | 0.15 | 17.2 |
| 15 | 792 | 2.78 | 2.23 | 0.55 | 2.57 | 0.065 | 7.6 |

Industrial Applicability

This invention is useful in the manufacture of magnetic thin film structures including Permalloy nickel-iron alloy, such as magnetic recording heads, magnetic bubble devices, plated wire memory, plated wire sensors, and the like.

Having thus described our invention, what we claim as new and desire to secure by Letters Patent is:

1. A nickel-iron electroplating method for plating NiFe alloy onto a substrate with a relatively high degree of uniformity of magnetic nickel-iron alloy composition over a range of plating current densities comprising, an aqueous plating bath solution at a temperature in the range from about 20° C. to about 35° C., placing a substrate with a complex topographical shape in said plating bath solution, employing a constant current plating density from about 2 milliamperes per centimeter squared to about 12 milliamperes per centimeter squared, said plating bath solution having ferrous ion concentration in the range from about 0.15 to about 0.3 grams per liter and a nickel ion concentration in the range from about 10 to about 14 grams per liter, with a pH of the bath of about 3, maintaining continuous agitation of a paddle moving over the surface of the cathode at a distance of about 2–3 millimeters at a rate of about 1 cycle per second, and thereby providing differences of less than about 2% by weight in the nickel/iron composition ratio of the NiFe magnetic alloy produced across said complex topographical shape.

2. A method in accordance with claim 1 wherein said current density is within a preferred range from about 4 milliamperes per centimeter squared to about 8 milliamperes per centimeter squared.

3. A nickel-iron electroplating method for plating alloys of NiFe onto a substrate with a relatively high degree of uniformity of magnetic nickel-iron composition over a range of plating current densities comprising, an aqueous plating bath solution including about
Ni ions: 13.7 g/l with selected Cl and $SO_4$ ions
Fe ions: 0.2 to 0.3 g/l
pH: 3
$H_3BO_3$: 25 g/l
Sodium Saccharin: 1.5 g/l
NaCl: 0 to 50 g/l said bath being maintained in a container at a temperature of about 30° C., continuously reciprocating a paddle at a rate of about 1 cycle per second moving over the surface of the cathode to be plated providing continuous agitation of the bath near the surface to be plated for the purpose of maintaining substantially constant bath compositions throughout the thickness of the film being plated, and providing a continuous current density of about 5–10 ma/cm$^2$.

4. A nickel-iron electroplating method for plating alloys of NiFe onto a substrate with a relatively high degree of uniformity of magnetic nickel-iron composition over a range of plating current densities comprising, an aqueous plating bath solution including about
Ni ions: 12.4 g/l with selected Cl and $SO_4$ ions
Fe ions: 0.24 g/l
pH: 3
$H_3BO_3$: 25 g/l
Sodium Saccharin: 0.75 g/l
NaCl: 25 g/l said bath being maintained in a container at a temperature of about 23° C., continuously reciprocating a paddle at a rate of about 1 cycle per second moving over the surface of the cathode to be plated providing continuous agitation of the bath near the surface to be plated for the purpose of maintaining substantially constant bath compositions throughout the thickness of the film being plated, and providing a continuous current density of about 4 ma/cm$^2$.

5. A nickel-iron electroplating method for plating alloys of NiFe onto a substrate with a relatively high degree of uniformity of magnetic nickel-iron composition over a range of plating current densities comprising, an aqueous plating bath solution including about
Ni ions: 13.7 g/l with selected Cl and $SO_4$ ions
Fe ions: 0.04 g/l
pH: 3
$H_3BO_3$: 25 g/l
Sodium Saccharin: 1.5 g/l NaCl: 0 to 50 g/l said bath being maintained in a container at a temperature of about 30° C., continuously reciprocating a paddle at a rate of about 1 cycle per second moving over the surface of the cathode to be plated providing continous agitation of the bath near the surface to be plated for the purpose of maintaining substantially constant bath compositions throughout the thickness of the film being plated, and providing a continuous current density of about 4 ma/cm$^2$, whereby about 5% Fe is provided in the alloy.

6. A nickel-iron electroplating method for plating alloys of NiFe onto a substrate with a relatively high degree of uniformity of magnetic nickel-iron composition over a range of plating current densities comprising, an aqueous plating bath solution including about
Ni ions: 13.7 g/l with selected Cl and $SO_4$ ions
Fe ions: 0.12 g/l
pH: 3
$H_3BO_3$: 25 g/l
Sodium Saccharin: 1.5 g/l
NaCl: 0 to 50 g/l said bath being maintained in a container at a temperature of about 30° C., continuously reciprocating a paddle at a rate of about 1 cycle per second moving over the surface of the cathode to be plated providing continuous agitation of the bath near the surface to be plated for the purpose of maintaining substantially constant bath compositions throughout the thickness of the film being plated, and providing a continuous current density of about 4 ma/cm$^2$, whereby about 10% Fe is provided in the alloy.

7. A nickel-iron electroplating method for plating alloys of NiFe onto a substrate with a relatively high degree of uniformity of magnetic nickel-iron composition over a range of plating current densities comprising, an aqueous plating bath solution including about
Ni ions: 13.7 g/l with selected Cl and $SO_4$ ions
Fe ions: 0.21 g/l
pH: 3
$H_3BO_3$: 25 g/l
Sodium Saccharin: 1.5 g/l
NaCl: 0 to 50 g/l said bath being maintained in a container at a temperature of about 30° C., continuously reciprocating a paddle at a rate of about 1 cycle per second moving over the surface of the cathode to be plated providing continuous agitation of the bath near the surface to be plated for the purpose of maintaining substantially constant bath compositions throughout the thickness of the film being plated, and providing a continuous current density of about 4 ma/cm$^2$, whereby about 15% Fe is provided in the alloy.

8. A nickel-iron electroplating method for plating alloys of NiFe onto a substrate with a relatively high degree of uniformity of magnetic nickel-iron composition over a range of plating current densities comprising, an aqueous plating bath solution including about
Ni ions: 13.7 g/l with selected Cl and $SO_4$ ions
Fe ions: 0.29 g/l
pH: 3
$H_3BO_3$: 25 g/l
Sodium Saccharin: 1.5 g/l
NaCl: 0 to 50 g/l said bath being maintained in a container at a temperature of about 30° C., continuously reciprocating a paddle at a rate of about 1 cycle per second moving over the surface of the cathode to be plated providing continuous agitation of the bath near the surface to be plated for the purpose of maintaining substantially constant bath compositions throughout the thickness of the film being plated, and providing a continuous current density of about 4 ma/cm$^2$, whereby about 20% Fe is provided in the alloy.

9. A nickel-iron electroplating method for plating Ni-Fe alloy onto a substrate with a relatively high degree of unformity of magnetic nickel-iron alloy composition over a range of plating current densities comprising an aqueous plating bath solution at a temperature in the range from about 20° C. to about 35° C., placing a substrate with a complex topographical shape in said plating bath solution, employing a constant current plating density from about 2 milliamperes per centimeter squared to about 12 milliamperes per centimeter squared, said plating bath solution consisting essentially of ferrous ion concentration in the range from about 0.15 to about 0.3 grams per liter with Cl and $SO_4$ ions and a nickel ion concentration in the range from about 10 to about 14 grams per liter with ions of $SO_4$ with boric acid, sodium saccharin and sodium chloride, with a pH of the bath of about 3, maintaining continuous agitation of a paddle moving over the surface of the cathode at a distance of about 2–3 millimeters at a rate of about 1 cycle per second, and thereby providing differences of less than about 2% by weight in the nickel/iron composition ratio of the NiFe magnetic alloy produced across said complex topographical shape.

* * * * *